US007101200B1

(12) United States Patent
Harlan et al.

(10) Patent No.: US 7,101,200 B1
(45) Date of Patent: Sep. 5, 2006

(54) ELECTRICAL CONNECTOR HAVING CIRCUIT BOARD RETENTION STRUCTURE

(75) Inventors: Tod M. Harlan, Mechanicsburg, PA (US); Robert W. Brown, Harrisburg, PA (US); Iosif R. Korsunsky, Harrisburg, PA (US); Joanne E. Shipe, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/096,572

(22) Filed: Apr. 1, 2005

(51) Int. Cl.
*H01R 4/66* (2006.01)

(52) U.S. Cl. ..... 439/108

(58) Field of Classification Search ..... 439/74, 439/108, 567, 82, 75, 78, 79, 751
See application file for complete search history.

(56) References Cited

U.S. PATENT DOCUMENTS 5,411,404 A * 5/1995 Korsunsky et al. ..... 439/108
5,618,187 A * 4/1997 Goto ..... 439/79
6,010,368 A * 1/2000 Tai ..... 439/637
6,290,515 B1 * 9/2001 Lee ..... 439/108
6,616,459 B1 * 9/2003 Norris ..... 439/751
6,634,893 B1 * 10/2003 Korsunsky et al. ..... 439/82
6,676,450 B1 * 1/2004 Schroll ..... 439/608
6,793,541 B1 * 9/2004 Yamaguchi et al. ..... 439/751

* cited by examiner

*Primary Examiner*—Tulsidas C. Patel
*Assistant Examiner*—Harshad Patel
(74) *Attorney, Agent, or Firm*—Wei Te Chung

(57) ABSTRACT

An electrical connector (100) adapted for mounting on a printed circuit board (300) includes an insulative housing (1) and a number of conductive contacts (2) attached to the housing. The conductive contacts include a number of signal contacts (20) and a number of ground contacts (22). Each ground contact includes a pair of solder tails (30). The solder tails include retention type tails (32) positioned in selected positions of the insulative housing and non-retention type tails (34). Each retention type tail includes a pair of lateral bulge (36) in back to back manner for interfering with corresponding through hole of the printed circuit board (300).

4 Claims, 6 Drawing Sheets

ELECTRICAL CONNECTOR HAVING CIRCUIT BOARD RETENTION STRUCTURE

BACKGROUND OF THE INVENTION

1. Field of the Invention

This invention generally relates to an electrical connector which is mounted on a printed circuit board, and more particularly to one provided with circuit board retention structure.

2. Description of the Prior Art

There are currently numerous electrical connectors commercially available which are mounted on a printed circuit board. In order to aid in placement accuracy, location assistance or to prevent connector movement while mounting to the printed circuit board, there is a need to add a hold down feature. Generally, it is most cost effective to add such a function to an existing component in an assembly, rather than adding a new component. For instance, if a housing has an integrated, molded orientation post, a crush rib could be added which would provide interference with the hole on the printed circuit board. However, if the same approach is used with a through hole component in a variable pin count connector and every one of the contacts contains a retention feature, as the connector length grows longer, the number of hold down increases, the insertion force would accordingly increase even be out of a desirable range. So, to meet the requirement of a maximum force, only a part of the contacts are modified to have the retention feature.

U.S. Pat. No. 6,634,893 B1, issued to Hon Hai, discloses such an electrical connector having some contact tails with retention features and others contact tails without retention feature. The contact tails are overlapped in pairs and each pair of contact tails is inserted into the through hole of a printed circuit board. Some contact tails with retention features, called retention contact tails, have longitudinally extending protrusions deviating from each other for bearing against peripheral walls of the through holes of the printed circuit board. The retention contact tail defines a notch at a side thereof and has a barb protruding outwardly from an opposite side thereof. In use, the barbs of the retention contact tails will be subject to forces substantially along a longitudinal direction of the connector.

The present invention concerns contact tails of the above kind in general but with a different design in creating the retention force.

BRIEF SUMMARY OF THE INVENTION

It is an object of the present invention to provide an electrical connector having a number of retention contact which is able to preferably engage with the printed circuit board.

In order to attain the objective above, an electrical connector adapted for mounting on a printed circuit board includes an elongated insulative housing and a number of conductive contacts attached to the housing. The housing defines a mating face adapted for mating with a complementary connector and a mounting face for being mounted on the printed circuit board. The housing includes two side walls and two end walls together defining a receiving space. The insulative housing further includes a central wall parallel to the two side walls and dividing the receiving space into two receiving slots. The central wall defines two rows of central passageways in opposite sides thereof, and the side wall defines a row of side passageway. The conductive contact includes a number of signal contacts and a number of ground contacts. Each ground contact is made up of a pair of identical contact pieces oriented in back to back manner. Each ground contact includes a tail portion, the tail portion includes retention type tail and non-retention type tail, while the retention type tails include a pair of lateral bulges for interfering with the printed circuit board.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
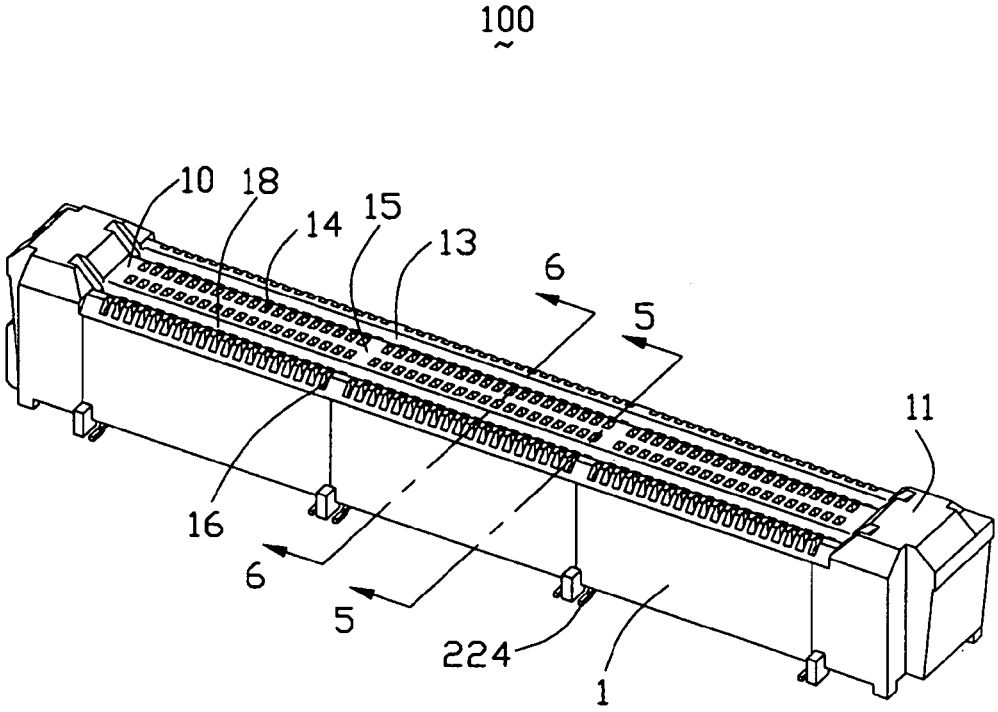
FIG. 1 is a perspective view of an electrical connector according to the present invention.
Figure 2:
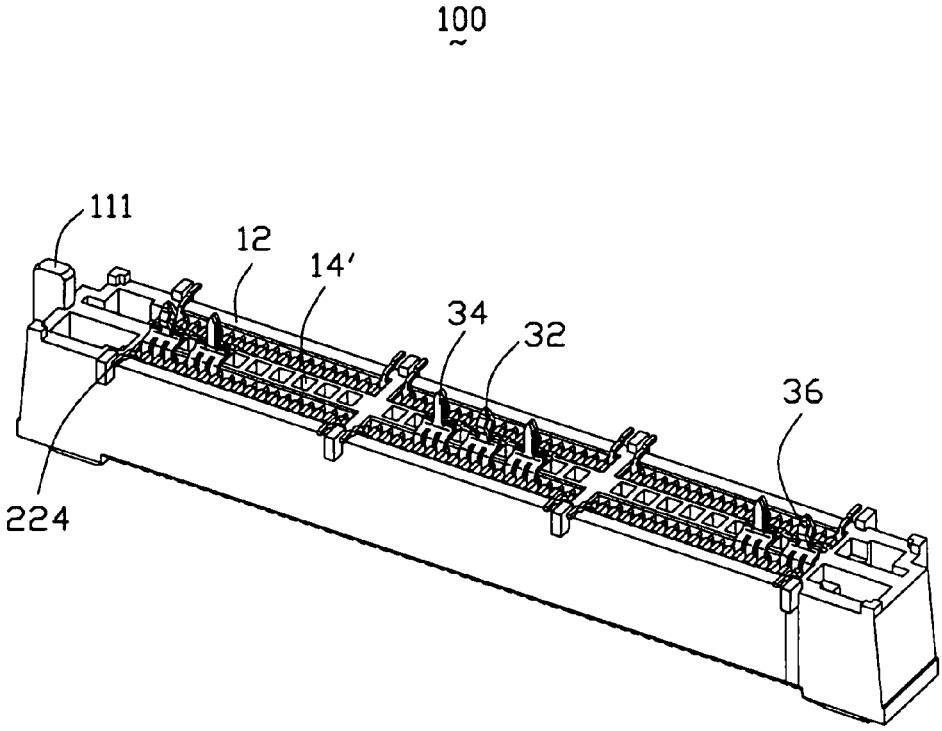
FIG. 2 is another perspective view of the electrical connector from a bottom view.
Figure 3:
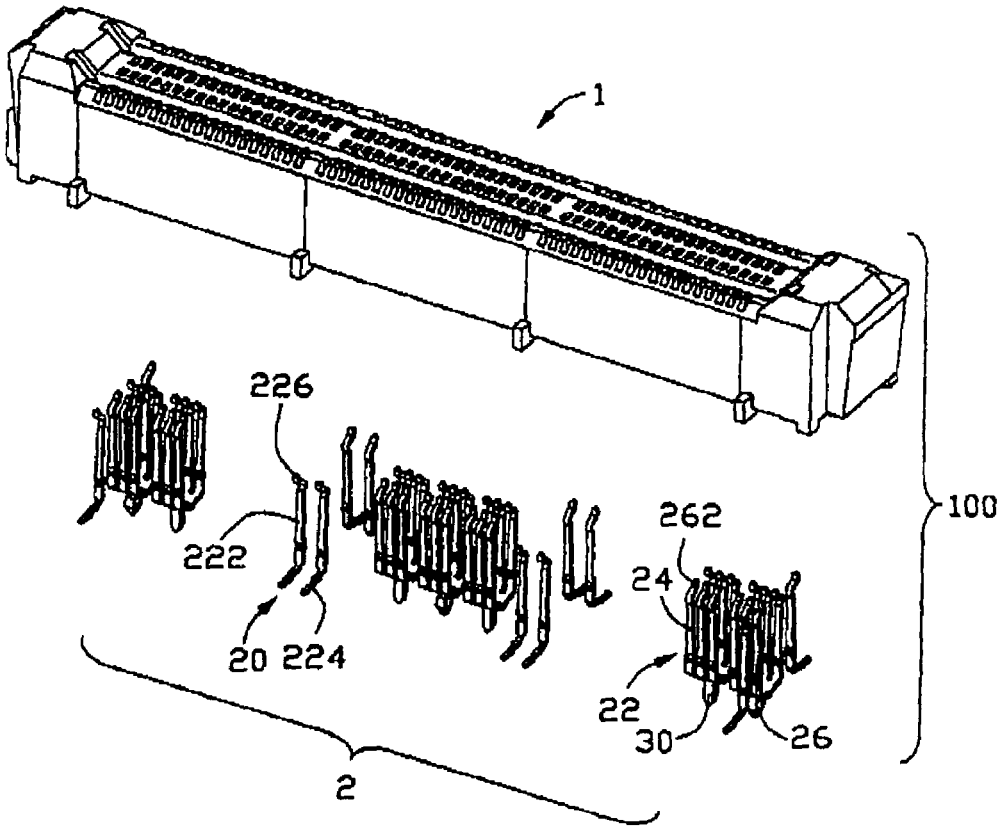
FIG. 3 is an exploded view of the electrical connector.

Refer to FIGS. 1–3, an electrical connector 100 adapted for mounting on a printed circuit board 300 having a plurality of through holes 302 in accordance with the present invention comprises an elongated insulative housing 1 and a number of conductive contacts 2 attached to the insulative housing 1. The insulative housing 1 defines a mating face 10 adapted to mate with a complementary connector (not shown) and an opposite mounting face 12 for being mounted onto the printed circuit board 300.

Figure 5:
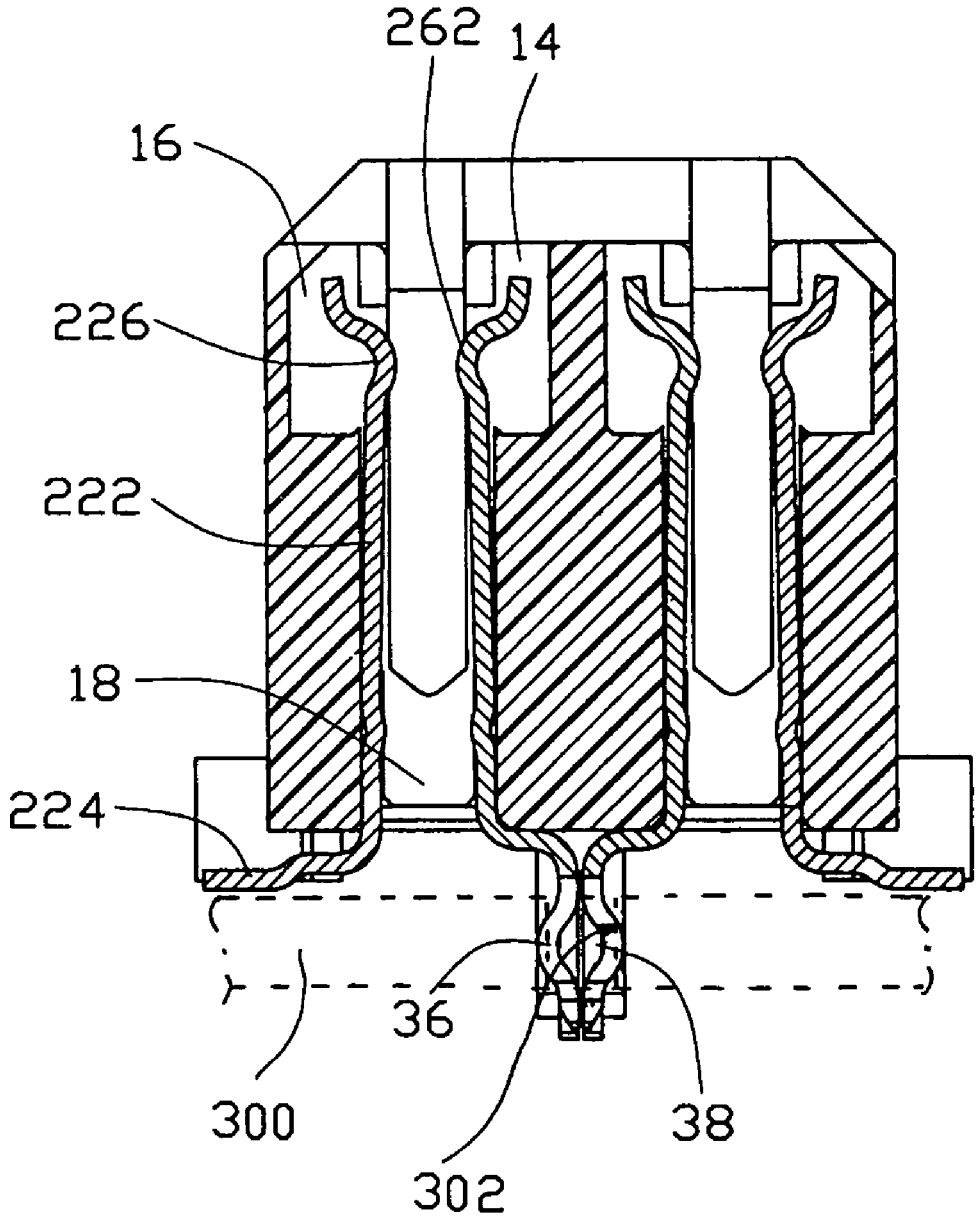
FIG. 5 is a cross section view of the electrical connector taken from 5—5 line of FIG. 1.
Figure 6:
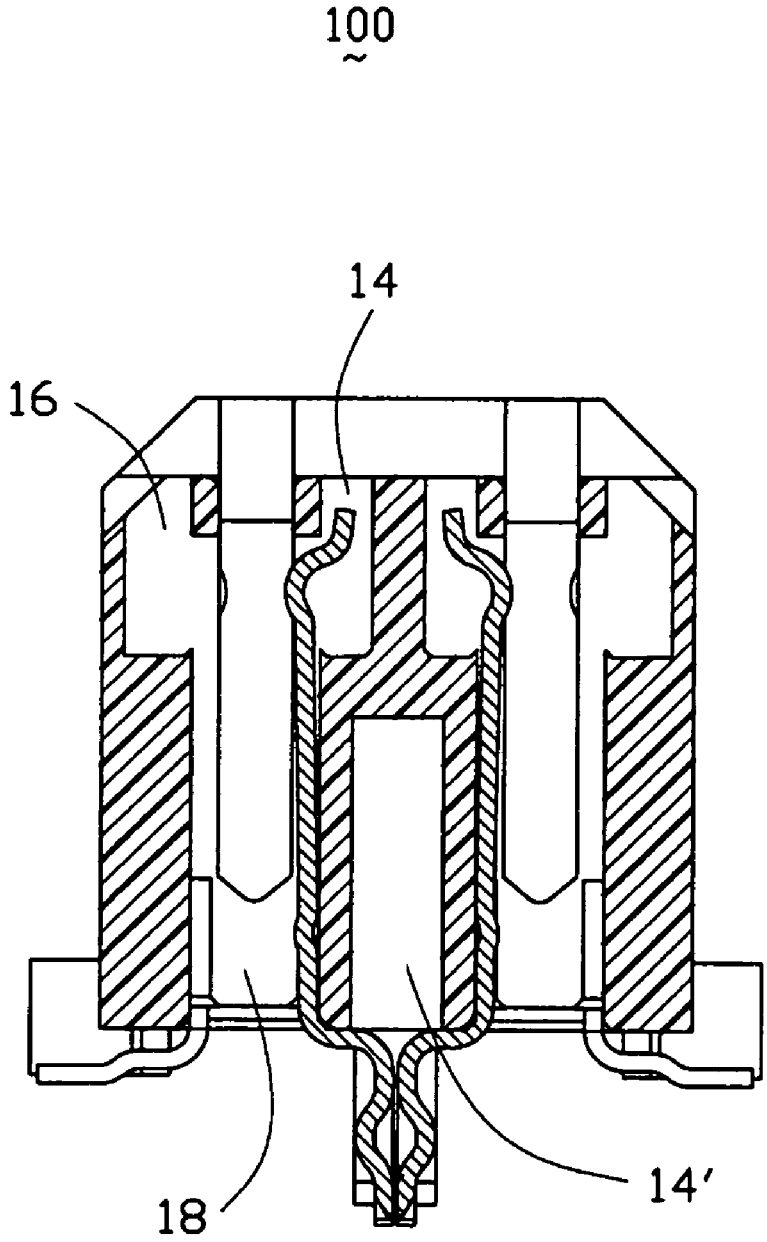
FIG. 6 is a cross section view of the electrical connector taken from 6—6 line of FIG. 1.

Further refer to FIGS. 1–2 in conjunction with FIGS. 5–6, the insulative housing 1 includes two side walls 13 and two end walls 11 together defining a receiving space (not labeled) therebetween. One of the end wall 11 forms an orientation post 111. Each side wall 13 defines a plurality of side passageways 16 along a longitudinal direction in the mating face 10. The insulative housing 1 further defines a central wall 15 parallel to the two side walls 13 and dividing the receiving space into two receiving slots 18. The central wall 15 defines two rows of central passageways 14 along two opposite sides thereof in the mating face 10. Further, the central wall 15 defines a row of central wall 14' in the mounting face 12 which do not communicate with the central wall 14 of the mating face 10. It is to be noted that, in this preferred embodiment, each central passageway 14 of the mating face 10 and the side passageway 16 own the same centerline in a lateral direction. In addition, the two receiving slots 18 communicate with the center passageways 14 and the side passageways 16.

Figure 4:
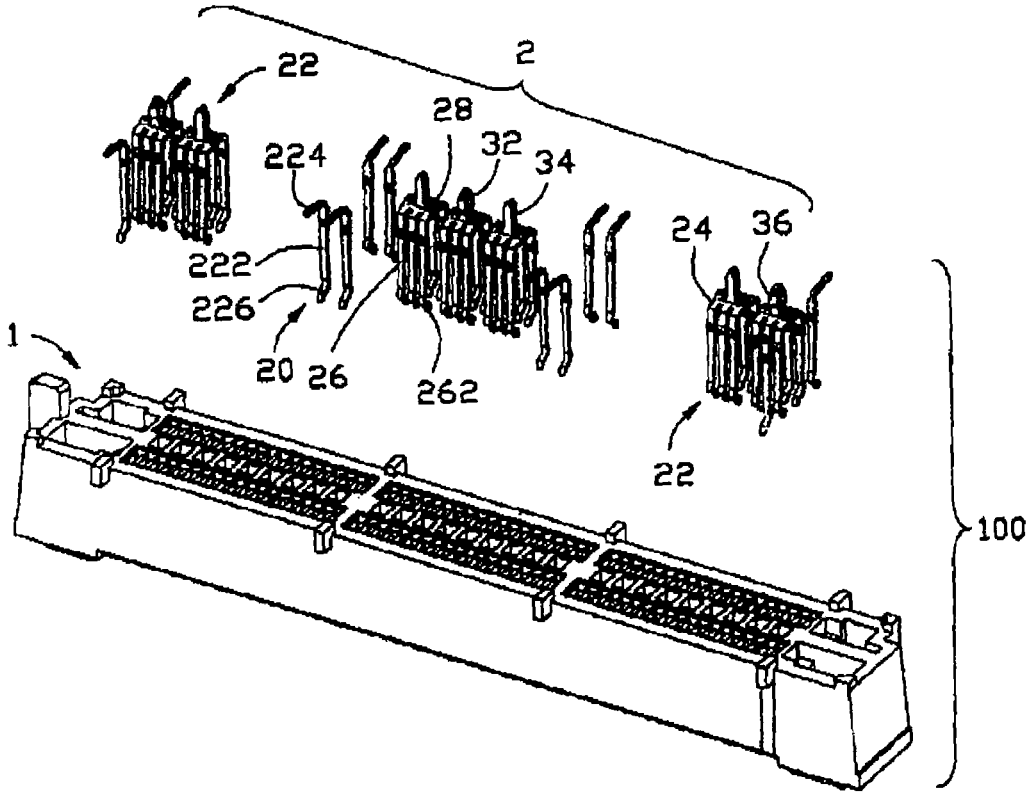
FIG. 4 is another exploded view of the card connector.

Refer to FIGS. 3–4 in conjunction with FIG. 5, the conductive contacts 2 include a number of first contacts 20 and a number of second contacts 22. In this preferred embodiment, the first contacts 20 are signal contacts and the second contacts 22 are ground or power contacts 22. The signal contacts 20 are arranged in rows and disposed at opposite sides of the ground contacts 22 along a longitudinal direction of the housing 1. The ground contact 22 is made up of two identical contact pieces 24 oriented in back to back manner. Each contact piece 24 includes a connecting portion 28, a three spring element 26 upwardly extending from the connecting portion 28, and a solder tail 30 downwardly extending from a center portion of the connecting portion 28. Each contact of three spring element 26 defines a curved portion 262 at a free end thereof for engaging with the complementary connector. The signal contact 20 includes a vertical main body 222, a tail portion 224 laterally extending from a free end of the main body 222 and a mating portion 226 curved from opposite end of the main body 222. It is noted that the curved portion 262 of the ground contact 22 and the mating portion 226 of each signal contact 20 are identical in structure except that they are oriented in back to back manner and respectively disposed at central passageways 14 and the side passageways 16 of the insulative housing 1.

Next, the structure of the conductive contacts 2 will be described briefly. Further referring to FIGS. 2–4, the solder tails 30 of the ground contacts 22 include retention type tails 32 and non-retention type tails 34 arranged along a longitudinal direction of the housing 1 in a manner that one retention type tail 32 is followed by several non-retention type tails 34. In this preferred embodiment, to meet the requirement of maximum insertion force, the retention type tails 32 are provided at two ends and center position of the housing 1. The retention type tails 32 include a pair of lateral bulges or arc portions 36 approximated to a free tip thereof and positioned in back to back manner, thereby defining a slot 38 therebetween (shown in FIG. 5). When the retention type tails 32 are inserted in corresponding plated through holes 302 of the printed circuit board 300, the lateral bulges or arc portions 36 engage with peripheral walls of the plated through holes 302 and the slots 38 are distorted, thereby producing a symmetrical retention force for preferably maintaining the connector 100 to the printed circuit board 300. The retention force can be controlled to an acceptable degree by changing the radian of the lateral bulge 36.

Further refer to FIGS. 2–3 in conjunction with FIGS. 5–6, the arrangement or engagement of the conductive contacts 2 and the housing 1 according to the present invention will be described. The conductive contacts 2 are disposed side by side along the longitudinal direction of the insulative housing 1. The ground contacts 22 are inserted into the center passageways 14 of the housing 1 from the mounting face 12, while the connecting portions 28 are disposed above the central passageways 14' of the mounting face 12 and the solder tails 30 are beyond the mounting surface 12 of the housing 1. The signal contacts 20 are inserted into the side passageways 16 of the housing 1, wherein the solder tail 224 are laterally beyond the mounting face 12 of the housing 1. Due to the receiving slots 18 communicate with the central passageways 14 and the side passageways 16, the ground contacts 22 and the signal contacts 20 are able to cooperate to mate with the complementary connector.

When the electrical connector 100 is mounted on the printed circuit board 300, the solder tails 30 are inserted into the plated through holes 302 of the printed circuit board 300, the lateral bulges 36 of the retention type tails 32 interfere with the peripheral walls of the plated through hole 302 and deflect thereby producing a symmetrical retention force therebetween in a lateral direction. The retention force can be controlled to a reasonable degree by changing the radian of the bulge or arc portion 36. The non-retention type tails 34 do not interfere with the plated through holes 302 and no retention force is produced therebetween.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a printed circuit board defining at least one through hole therein;

an electrical connector including an insulative housing with a plurality of signal contacts retained in the housing; and at least one pair of ground contacts positioned at a selected position in the housing, said at least one pair of ground contacts having two back to back overlapped tail portions extending beyond the mounting face and retained in said at least one through hole of the printed circuit board, each tail portion forming an outwardly extending arcuate portion at approximately a distal end thereof for deformable engagement with the through hole, said arcuate portions spatially opposing each other and defining therebetween a slot, the arcuate portions being insertably deformed laterally in said at least one through hole of the printed circuit board; wherein the housing defines a card receiving slot, the ground contact defines an upper contact portion laterally extending toward and into the card receiving slot, and the arcuate portion also laterally extends toward the card receiving slot similar to said upper contact portion.

2. The assembly as claimed in claim 1, wherein tips of said at least one pair of ground contacts are engaged with each other when the arcuate portions are deformed in said at least one through hole.

3. The assembly as claimed in claim 1, wherein tips of said at least one pair of ground contacts are engaged with each other before the arcuate portions are deformed in said at least one through hole.

4. The assembly as claimed in claim 1, wherein said at least one pair of ground contacts include a pair of curved contacting portions each extending into a corresponding receiving slot of the housing.

* * * * *